United States Patent [19]

Roberts et al.

[11] Patent Number: 4,936,911

[45] Date of Patent: Jun. 26, 1990

[54] COLD WORK STEEL

[75] Inventors: William Roberts, Lidingö; Börje Johansson, Hagfors, both of Sweden

[73] Assignee: Uddeholm Tooling Aktiebolag, Hagfors, Sweden

[21] Appl. No.: 399,491

[22] PCT Filed: Mar. 11, 1988

[86] PCT No.: PCT/SE88/00123

§ 371 Date: Sep. 7, 1989

§ 102(e) Date: Sep. 7, 1989

[87] PCT Pub. No.: WO88/07093

PCT Pub. Date: Sep. 22, 1988

[30] Foreign Application Priority Data

Mar. 19, 1987 [SE] Sweden ..... 8701127

[51] Int. Cl.[5] ..... C22C 29/04

[52] U.S. Cl. ..... 75/238; 75/239; 75/241; 75/246

[58] Field of Search ..... 75/238, 241, 239, 246

[56] References Cited

U.S. PATENT DOCUMENTS

| | | | |
|---|---|---|---|
| 4,121,929 | 10/1978 | Kawai et al. | 75/238 |
| 4,121,930 | 10/1978 | Yukawa et al. | 75/238 |
| 4,780,139 | 10/1988 | Hellman et al. | 75/240 |
| 4,863,515 | 9/1989 | Roberts et al. | 75/238 |

*Primary Examiner*—Stephen J. Lechert, Jr.
*Assistant Examiner*—Nina Bhat
*Attorney, Agent, or Firm*—Armstrong, Nikaido, Marmelstein, Kubovcik & Murray

[57] ABSTRACT

The invention relates to a cold work steel having a very high resistance to wear and good impact strength made powder-metallurgically through the consolidation of metal powder to a dense body. The powder has the following chemical composition expressed in weight-%: 0.5–2.5 C, 0.1–2 Si, 0.1–2 Mn, 0.5–1.5 N, max 15 Cr, preferably 6.5–111 Cr, max 4 Mo, max 1 W, 3–15 V, wherein up to half the amount of vanadium can be replaced by 1.5 times as much niobium, and part of the vanadium can be replaced by titanium at a content up to four times the content of nitrogen and the double amount of zirconium at a content up to eight times the content of nitrogen, and wherein the ratio V/(C+N) shall amount to not less than 2.5 and not more than 3.8, balance essentially only iron, impurities and accessory elements in normal quantities. The invention also relates to a method of manufacturing the steel. First there is made a steel powder having a composition as above with the exception of the nitrogen content. The nitrogen content in the powder is max 0.5%. The powder is nitrided by means of nitrogen gas in the ferritic state of the steel at a temperature between 500° and 1000° C., preferably between 650° and 850° C. during so long period of time that the nitrogen content in the steel is increased to an amount of between 0.5 and 1.5% and such that the ratio V/(C+N) will be not less than 2.5 and not more than 3.8, and thereafter the powder is consolidated to a homogeneous body with full density.

14 Claims, 2 Drawing Sheets

COLD WORK STEEL

TECHNICAL FIELD

This invention relates to a cold work steel, i.e. a tool steel intended for use near room temperature, in the first place for cutting and punching metallic materials but also for plastically forming cold working operations, as for example for deep-drawing tools and for cold-rolling rollers. The invention also relates to a method of manufacturing the steel utilizing powder-metallurgy including the consolidation of metal powder to a dense body. The steel is inter alia characterized by a very high impact strength in combination with an extremely good wear resistance, which makes the steel very useful for punching and cutting tools.

BACKGROUND OF THE INVENTION

Cold work steels for cutting, punching or forming metallic materials shall fulfil a number of demands which are difficult to combine. Particularly high demands are raised upon the impact strength, especially when the tool is intended for cutting or punching adhesive materials (adhesive wear), as for example austenitic stainless steels. Further, the tool material must not be too expensive, which limits the possibility of choosing high contents of expensive alloying components.

Conventional cold work steels are well qualified in the above mentioned respects. Nevertheless, it is, however, desirable to obtain tool materials having still better features. Therefore, in some cases, there have been used powder-metallurgically manufactured high speed steels, i.e. steels which are characterized by high contents of tungsten and/or molybdenum and usually also cobalt. High speed steels, however, are expensive. Therefore, it is desirable to obtain a cold work steel without using such expensive alloying elements as tungsten and/or cobalt, at least not high contents of said elements, but nevertheless a steel having cold working features which are comparable with or better than what is achieved by means of high speed steels made through the powder-metallurgical manufacturing technique.

The wear resistance of steels can also be improved by providing the steel object with a thin coating of a very wear resistant material. Particularly, the so called CVD-technique (CVD=Chemical Vapour Deposition) gives a very wear resistant surface layer and as a matter of fact it is the most efficient method known and available today for improving the wear resistance. Unfortunately, the method also have some drawbacks which often render it impossible to use; it can be utilized only for the coating of comparatively small objects; the siz tolerances cannot be adjusted to any greater extent after the application of the CVD-coating; and it is very expensive.

BRIEF DISCLOSURE OF THE INVENTION

With reference to the above mentioned background it is an object of the invention to provide a new, powder-metallurgically produced cold work steel with a wear resistance and a toughness which is better than or comparable with that of powder-metallurgically produced high speed steels and having a combination of toughness and wear resistance better than that of conventional, high alloyed cold work steels. As far as the wear resistance is concerned, it is also a specific object of the invention to bring about a wear resistance which is comparable with that of CVD-coated, powder-metallurgically produced steels having a similar content of alloying elements. The steel shall, in order to achieve the above mentioned objects, contain 0.5–2.5% C, 0.1–2% Si, 0.1–2% Mn, 0.5–1.5% N, max 15% Cr, preferably 6.5–11% Cr, max 4% Mo, max 1% W, 3–15% V, wherein up to half the amount of vanadium can be replaced by 1.5 times as much niobium, and part of the vanadium can be replaced by titanium at a content up to four times the content of nitrogen and the double amount of zirconium at a content up to eight times the content of nitrogen, and wherein the ratio V/(C+N) shall amount to not less than 2.5 and not more than 3.8, balance essentially only iron, impurities and accessory elements in normal quantities. The total content of carbides, nitrides and carbonitrides amounts to between 5 and 20 volume-%, preferably between 5 and 12 volume-%. Carbon which is not bound in the form of carbides or other hard components, about 0.5–1% C, is dissolved in the steel matrix.

The steel according to the invention can be manufactured in the following way. A melt of molten metal is provided, the melt containing max 0.5N and in other respects having the composition identified above. From this melt there is made a metal powder, suitably through conventional gas atomization, nitrogen being used as an atomization gas. This powder is heated to a temperature between 500° and 1000° C., preferably to between 650° and 850° C., however not above the $A_{C1}$-temperature of the steel and is nitrided by means of nitrogen gas in the ferritic state of the steel at the said temperature for so long period of time that the nitrogen content in the steel is increased through the diffusion of nitrogen into the steel to a content of between 0.5 and 1.5%, and so that the ratio V/(C+N) will be not less than 2.5 and not more than 3.8. Thereafter the nitrided powder is consolidated to form a fully dense, homogeneous body.

Steels with three different vanadium contents within the frame of the above defined composition have been studied. More closely there have been studied a steel containing about 4% V and a steel containing about 10–11% V. In the first mentioned case also the carbon and the nitrogen contents varied, the total amount of carbon and nitrogen amounting to about 1.4%. In the case when the vanadium content approached 11%, the content of C+N was about 2.9%. Also a steel containing about 6% V has been studied, but this steel contained only normal amounts of nitrogen. The results which have been achieved as well as theoretic considerations have indicated that the contents of carbon and nitrogen shall satisfy the following conditions at different vanadium contents:

$$1.4 \leqq (C+N) \leqq 2.0, \text{ when } 3 \leqq V \leqq 5, \text{ and } 2.5 \leqq V/(C+N) \leqq 3.0$$

$$1.8 \leqq (C+N) \leqq 3.0, \text{ when } 5 \leqq V \leqq 7$$

$$2.5 \leqq (C+N) \leqq 4.0, \text{ when } 9 \leqq V \leqq 11$$

The above equations which define the contents of carbon and nitrogen in relation to the contents of vanadium are due to the following considerations. The carbon content in the matrix of the steel shall be so high that the desired hardness in the matrix is achieved after hardening and tempering, such that a high pressure strength is obtained in order to avoid problems because of blunting due to deformation of cutting edges in the case when the steel shall be used for punching or cutting tools.

The steel shall contain as much vanadium-carbonitrides as is possible without the toughness being reduced to an unacceptable level, i.e. in order to obtain as optimal mode of operation as is possible through low friction between tool and work piece and through sufficient toughness for avoiding flaking.

Further characteristic features and aspects on the steel and its manufacturing according to the invention will be apparent from the following description of performed experiments and from the appending claims.

BRIEF DESCRIPTION OF THE DRAWINGS

In the following description reference will be made to the attached drawings, in which FIG. 1 in the form of a diagram illustrates the wear of punches made of tested material as a function of the number of cutting operations in the case of punching stainless steel (adhesive wearing conditions), FIG. 2 in a corresponding mode illustrates the wear of the punches in the case of punching high strength steel strips (abrasive wearing conditions), and FIG. 3 in the form of bar charts illustrates the impact strength of a number of examined steels through testing un-notched test bars at room temperature.

DESCRIPTION OF PERFORMED TESTS

Figure 1:
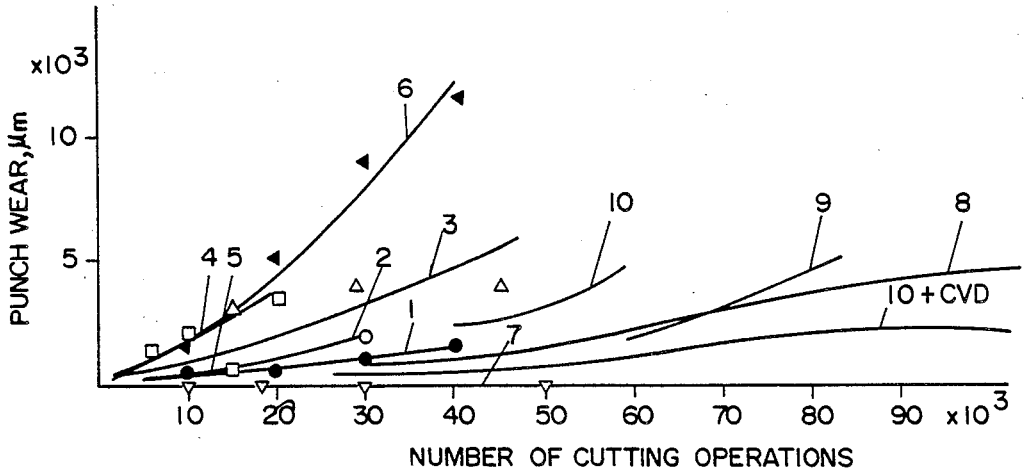

The chemical compositions of those steels which were examined are apparent from Table 1. All the indicated contents refer to weight-%. Besides those elements which are mentioned in the table, the steels also contained impurities and accessory elements in normal amounts, balance iron.

TABLE 1

| Steel No. | C | Si | Mn | Cr | Mo | V | W | Co | N | |
|---|---|---|---|---|---|---|---|---|---|---|
| | | | | | | | | | | V/C |
| 1 | 1.24 | 1.00 | 0.42 | 7.90 | 1.54 | 4.07 | — | — | — | 3.3 |
| 2 | 1.93 | 0.94 | 0.44 | 8.30 | 1.50 | 6.20 | — | — | — | 3.2 |
| 3 | 2.93 | 0.95 | 0.49 | 8.40 | 1.50 | 10.3 | — | — | — | 3.5 |
| 4 | 1.28 | 0.5 | 0.3 | 4.2 | 5.0 | 3.1 | 6.4 | — | — | 2.8 |
| 5 | 2.3 | 0.4 | 0.3 | 4.2 | 7.0 | 6.5 | 6.5 | 10.5 | — | 2.8 |
| 6 | 1.55 | 0.3 | 0.3 | 12.0 | 0.8 | 0.8 | — | — | — | 0.7 |
| | | | | | | | | | | V/(C + N) |
| 7 | 1.89 | 0.87 | 0.40 | 8.50 | 1.38 | 10.8 | — | — | 1.0 | 3.7 |
| 8 | 0.6 | 1.0 | 0.4 | 7.9 | 1.7 | 4.0 | — | — | 0.8 | 2.8 |
| 9 | 0.8 | 1.0 | 0.4 | 8.0 | 1.7 | 4.0 | — | — | 0.6 | 2.8 |
| | | | | | | | | | | V/C |
| 10 | 1.5 | 1.0 | 0.4 | 8.2 | 1.6 | 4.4 | — | — | 0.1 | 2.8 |

Steels Nos. 1–3 and 7–10 were made from gas atomized steel powder, which was consolidated in a manner known per se through hot isostatic pressing to full density. Steels Nos. 4, 5 and 6 consisted of commercially available reference materials. Steels Nos. 4 and 5 consisted of powder-metallurgically manufactured high speed steels, while steel No. 6 was a conventionally manufactured cold work steel. The compositions for steels Nos. 1–3 and 7–10 were analyzed compositions, while the compositions for the reference materials Nos. 4, 5 and 6 are nominal compositions.

Prior to consolidation steels Nos. 7, 8 and 9 were nitrided, so that they achieved those nitrogen contents which are indicated in Table 1. As starting materials there were used powders which contained nitrogen in normal amounts, i.e. about 0.1%, but which as far as other alloying elements are concerned had those compositions which are indicated in the table. The nitriding operation was performed in the ferritic state of the steels at a temperature of about 800° C. for a period of time of 1 h by means of nitrogen gas in a container at an interior over-pressure of 4 bar, wherein the nitrogen contents were increased through diffusion of nitrogen into the powder materials to the values indicated in Table 1. Due to the low nitrogenization temperature there was not obtained any particular change of the structure as for example coarsening of the carbides, in the steel powders. Nor did the powders sinter together. The powders therefore could be handled as a flowing material and could be charged in containers for the compaction procedure. An upper, partly oxidized layer of the powders was removed before the powders were emptied from the nitrogenization vessel. This layer worked as an oxygen consuming getter for the rest of the powder during the nitriding operation.

The compacted billets of steels Nos. 1, 2, 3, and 7, 8, 9 and 10 were forged to appr 80×40 mm. For the examination of the test materials, steels Nos. 1–3 and 7–10, and the reference materials, Nos. 4, 5 and 6, there were made punches having the diameter 10 mm and dies. The punches and the dies were hardened and tempered according to the following:

TABLE 2

| Steel No. | Austenitizing temperature (°C.) | Tempering temperature (°C.) | Hardness (HRC) |
|---|---|---|---|
| 1 | 1070 | 200 | 61 |
| 2 | 1050 | 200 | 62 |
| 3 | 1020 | 200 | 62 |
| 4 | 1150 | 570 | 61 |
| 5 | 1100 | 620 | 62 |
| 6 | 1020 | 200 | 62 |
| 7 | 1020 | 200 | 61 |
| 8 | 1070 | 200 | 59 |
| 9 | 1078 | 200 | 59 |
| 10 | 1070 | 200 | 60 |

One punch and one die of steel No. 10 were also supplied with a thin wear layer through CVD-deposition.

The manufactured punches and dies were used for wear experiments. First the resistance to wear was measured in terms of wear as a function of number of cutting operations in a 1 mm thick plate of stainless steel of type 18/8, i.e. under adhesive wear conditions. The results are illustrated in FIG. 1. This figure also shows a typical appearance of a defect caused by wear on a punching tool. The tool made of the steel No. 7 of the invention did not show any noticeable damage due to wear. Also the CVD-coated steel No. 10 exhibited a very good resistance to this type of wear as well as the steels 8 and 9 of the invention, which can be said to have a resistance comparable with that of the CVD-coated steel. Steels Nos. 1–3 also demonstrated a good resistance to this type of wear while the other tested materials had pronouncedly lower values.

Figure 2:
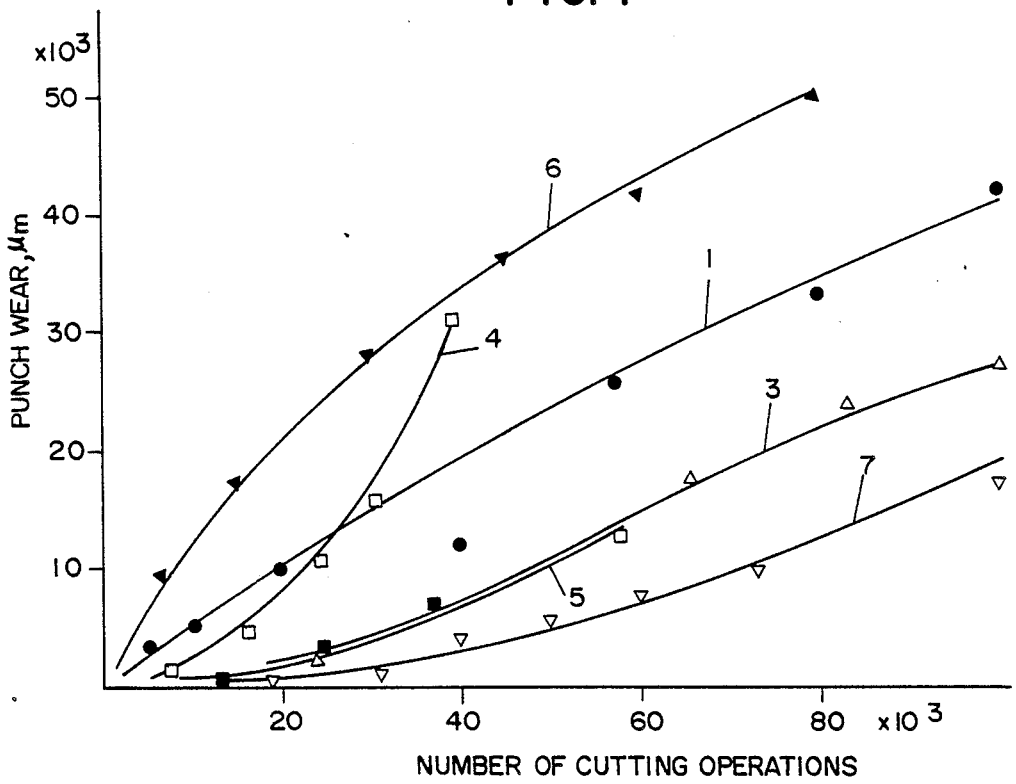
Figure 3:
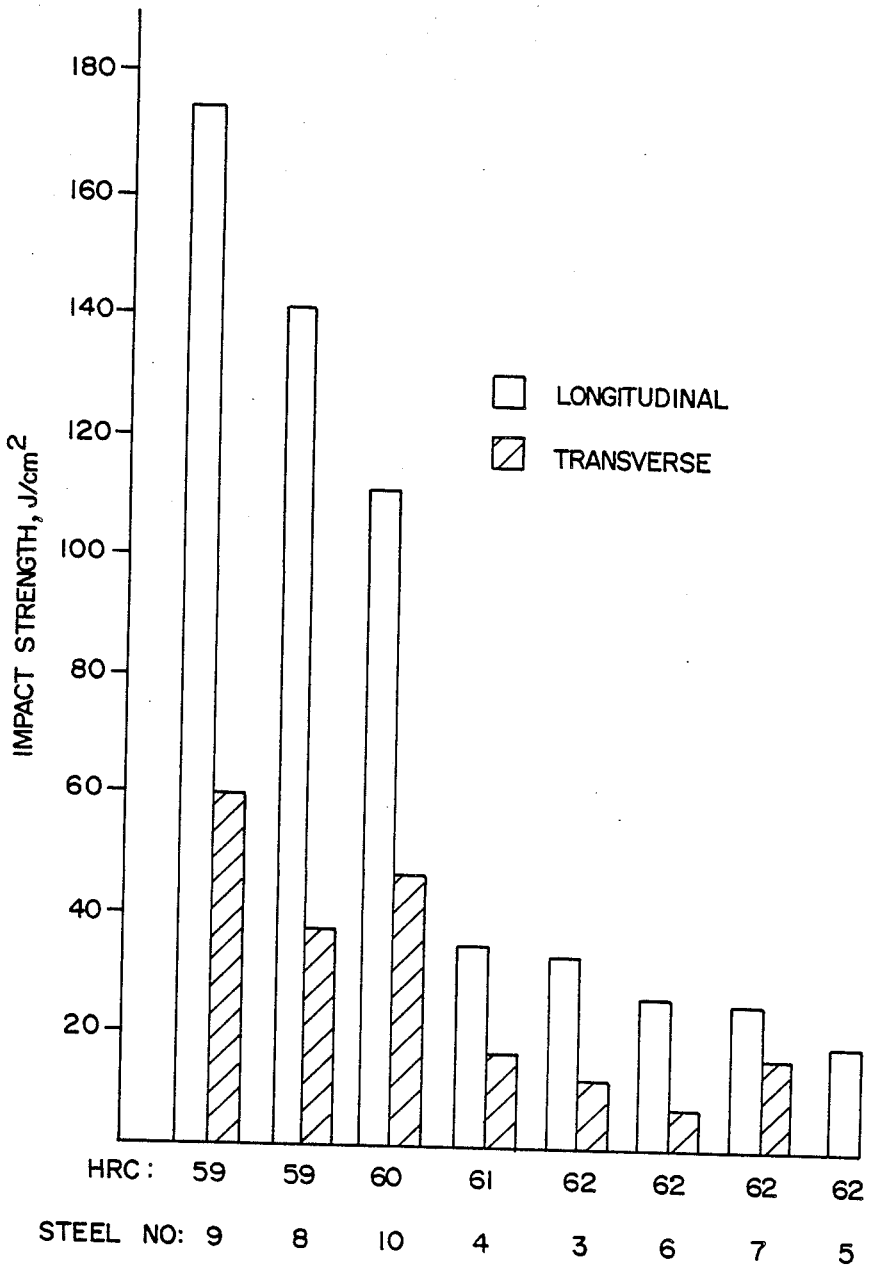

Thereafter also the wear punches manufactured of the tested materials (steels Nos. 1–7) was tested under abrasive wear conditions. The punching operations this time were performed in high strength steel strips. Also in this case the steel No. 7 of the invention showed least wear of all the tested steels. Next to steel No. 7 followed the more high alloyed steels Nos. 3 and 5. Steel No. 1 was not as good under these abrasive wear conditions, however, by far better than the cold work steel No. 6. The high speed steel No. 4 had quite a different picture as far as the wear is concerned. Initially the resistance to wear was good, but gradually the wear turned out to accelerate. The test results illustrated in FIGS. 1 and 2 demonstrate that the alloying with nitrogen had a very advantageous impact upon the resistance to wear of the punches and this improvement was particularly noticeable in the case of punching in adhesive materials, FIG. 1. This implies that the nitrogen alloyed cold work steel had a very low coefficient of friction to those materials which were punched and particularly to adhesive materials. One can claim that there was achieved a friction reducing effect through the nitriding of the powder prior to consolidation, corresponding to that effect which as far as the wear picture is concerned is achieved through the so called PVD and CVD methods (Physical Vapour Deposition and Chemical Vapour Deposition, respectively) but without the drawbacks of these methods such as high costs, need of special equipment, size tolerance problems etc. The consolidated material could also readily be worked to desired dimensions in unhardened condition.

To sum up, steel No. 7 had a combination of features which is the far best for cold work steels, particularly for punching and cutting tools, when the reistance to wear is the critical feature and moderately high demands are raised upon the impact strength.

Finally, the impact strength of the steels Nos. 3–7 and 8–10 was tested. The best impact strength values in the longitudinal direction were achieved with the steels Nos. 8 and 9 of the invention, and also the transverse impact strength was very high. Steel No. 7 on the other hand had comparatively bad impact strength values, which indicates that the applicability of this steel is more limited. Together the punch tests and the impact strength tests further show that the steels of the invention containing 3–5% vanadium and the carbon and nitrogen contents mentioned in the claims provide an optimal combination of features for cold work steels for the most frequent applications of cold work steels, while steels with higher vanadium contents in combination with the carbon and nitrogen contents as mentioned in the claims may be advantageous when very high demands are raised with reference to low wear while only normal demands are raised upon the toughness of the material.

We claim:

1. A cold work steel having very high resistance to wear and good impact strength, said steel being made powder-metallurgically by consolidation of metal powder to a dense body, characterized therein that it has the following chemical composition expressed in weight-%:

0.5–2.5C
0.1–2Si
0.1–2Mn
0.5–1.5N
6.5–11Cr
max 4Mo
max 1W
3–15V wherein up to half the amount of vanadium can be replaced by 1.5 times as much niobium, and part of the vanadium can be replaced by titanium at a content up to four times the content of nitrogen and the double amount of zirconium at a content up to eight times the content of nitrogen, and wherein the ratio V/(C+N) shall amount to not less that 2.5 and not more than 3.8, balance essentially only iron, impurities and accessory elements in normal quantities.

2. A cold work steel according to claim 1, characterized therein that it contains 8–12% V.

3. A cold work steel according to claim 2, characterized therein that it contains 1.5–2.5% C.

4. A cold work steel according to any of claims 1–3, characterized therein that the total amount of carbonitrides, where the main part of the carbonitrides consists of carbonitries of the M(C,N)-type, amounts to between 5 and 20 volume-%.

5. A cold work steel according to claim 1, characterized therein that it contains 3–5% V and 0.5–1.5% C.

6. A cold work steel according to claim 5, characterized therein that $1.4 \leqq (C+N) \leqq 2.0$, and that $2.5 \leqq V/(C+N) \leqq 3.0$.

7. A cold work steel according to claim 1, characterized therein that it contains 5–7% V and 1.0–2.0% C.

8. A cold work steel according to any of claims 1–3, characterized therein that it contains 7–10% Cr.

9. A cold work steel according to any of claims 1–3, characterized therein that it contains 0.5–3% Mo.

10. A cold work steel according to any of claims 1–3, characterized therein that it does not contain more than impurity amounts of W.

11. A cold work steel according to any of claims 1–3, characterized therein that it contains 0.2–0.9% Mn.

12. A cold work steel according to any of claims 1–3, characterized therein that it contains 0.5–1.5% Si.

13. A cold work steel according to claim 2, characterized therein that it contains 9–11% V.

14. A cold work steel according to claim 9, characterized therein that it contains 1–2% Mo.

* * * * *